US007887444B1

(12) United States Patent
Severa et al.

(10) Patent No.: US 7,887,444 B1
(45) Date of Patent: Feb. 15, 2011

(54) RACQUET HAVING ARTICULATING GROMMET ASSEMBLIES

(75) Inventors: William D. Severa, Darien, IL (US); Donald G. Loeffler, Gilberts, IL (US); Ronald R. Rocchi, Naperville, IL (US); Cory Boudreau, Madison, WI (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 12/641,957

(22) Filed: Dec. 18, 2009

Related U.S. Application Data

(60) Provisional application No. 61/233,737, filed on Aug. 13, 2009.

(51) Int. Cl.
*A63B 49/00* (2006.01)
*A63B 49/02* (2006.01)

(52) U.S. Cl. ..... 473/539; 473/540

(58) Field of Classification Search ..... 473/524, 473/537, 539, 540
See application file for complete search history.

(56) References Cited

U.S. PATENT DOCUMENTS

| | | | | |
|---|---|---|---|---|
| 3,642,283 | A | 2/1972 | Wilkens | 273/73 |
| 4,066,260 | A | 1/1978 | Rodgers, Jr. | 273/73 |
| 4,204,681 | A | 5/1980 | Hall Jr. et al. | 273/73 |
| 4,220,335 | A | 9/1980 | Nobbs | 273/73 |
| 4,314,699 | A | 2/1982 | Bayer et al. | 273/73 |
| 4,331,331 | A | 5/1982 | Rodgers, Jr. | 273/73 |
| 4,614,626 | A | 9/1986 | Frerking | 264/46.4 |
| 4,765,620 | A | 8/1988 | Janes | 273/73 |
| 4,786,055 | A | 11/1988 | Darling | 273/73 |
| 4,889,337 | A | 12/1989 | Todd | 273/73 |
| 4,913,434 | A | 4/1990 | Fischer | 273/73 |
| 5,092,016 | A | 3/1992 | Soong | 16/2 |
| 5,102,132 | A | 4/1992 | Chen | 273/73 |
| 5,137,274 | A | 8/1992 | Soong | 273/73 |
| 5,232,219 | A * | 8/1993 | Tseng | 473/539 |
| RE34,420 | E | 10/1993 | Darling | 273/73 |
| 5,251,895 | A | 10/1993 | Darling | 273/73 |
| 5,290,031 | A | 3/1994 | Natsume | 273/73 |
| 5,368,297 | A * | 11/1994 | Liu | 473/539 |
| 5,538,243 | A * | 7/1996 | Yamamoto et al. | 473/537 |
| 5,762,570 | A | 6/1998 | Shaw | 473/522 |
| 5,944,624 | A | 8/1999 | Davis et al. | 473/539 |
| 5,944,625 | A | 8/1999 | Janes et al. | 473/548 |
| 5,993,337 | A | 11/1999 | Janes et al. | 473/539 |
| 6,050,909 | A * | 4/2000 | Severa et al. | 473/524 |
| 6,254,499 | B1 | 7/2001 | Tarleton | 473/533 |
| 6,527,656 | B1 | 3/2003 | Cheng et al. | 473/540 |
| 6,530,851 | B2 | 3/2003 | Munster | 473/521 |
| 7,074,142 | B2 * | 7/2006 | Takeuchi et al. | 473/537 |
| 7,217,203 | B2 * | 5/2007 | Takeuchi et al. | 473/537 |
| 2002/0039937 | A1 | 4/2002 | Bothwell | 473/520 |
| 2002/0142869 | A1 | 10/2002 | Nevers | 473/534 |

* cited by examiner

*Primary Examiner*—Raleigh W. Chiu
(74) *Attorney, Agent, or Firm*—Terence P. O'Brien

(57) ABSTRACT

A sports racquet including a frame, at least one grommet assembly. The frame includes a head portion coupled to a handle portion. The head portion includes a hoop having inner and outer peripheral walls. At least a first set of concave recesses and channels are formed into the outer peripheral wall. The hoop includes first, second and third groups of string openings. The second and third groups of string openings are aligned with the first set of concave recesses. The second group of string openings extends through the outer peripheral wall at the first set of concave recesses. The grommet assembly engages the outer peripheral wall. The grommet assembly includes at least three pivotable elements interconnected by torque transmitting arms, each pivotable element including a string passage. The pivotable elements and the torque transmitting arms are pivotable about an axis parallel to a string bed plane.

21 Claims, 9 Drawing Sheets

RACQUET HAVING ARTICULATING GROMMET ASSEMBLIES

RELATED U.S. APPLICATION DATA

The present invention claims the benefit of the filing date under 35 U.S.C. §119(e) of U.S. Provisional Patent Application Ser. No. 61/233,737, filed on Aug. 13, 2009, which is hereby incorporated by reference in its entirety.

FIELD OF THE INVENTION

The present invention relates generally to a sports racquet. In particular, the present invention relates to racquet including a head portion having at least one articulating grommet assembly.

BACKGROUND OF THE INVENTION

Sport racquets, such as tennis, racquetball, squash and badminton racquets, are well known and typically include a frame having a head portion coupled to a handle portion. The head portion supports a string bed having a plurality of main string segments interwoven with a plurality of cross string segments. Many racquets also include a throat portion positioned between and connecting the handle portion to the head portion. The typical string bed of a sports racquet includes a central region, that provides the most responsiveness, the greatest power and the best "feel" to the player, upon impact with a ball, and a peripheral region. The central region, commonly referred to as the "sweet spot," is typically defined as the area of the string bed that produces higher coefficient of restitution ("COR") values. A higher COR generally directly corresponds to greater power and greater responsiveness.

Generally speaking, the size of the sweet spot of a racquet will increase with increased string segment length. The longer string segments enable the string bed to deflect more when impacting a ball and provide a longer "dwell time" between the string bed and the ball upon impact. The increased "dwell time" improves not only the responsiveness of a racquet, but also its control, including the ability to impart spin on the ball.

Some existing racquets incorporate a larger sized hoop portion supporting a larger sized string bed (i.e., a larger head size) in an effort to increase the size of the string bed and the sweet spot. However, as the head size of a racquet increases, so does the polar moment of inertia of the racquet. A racquet with a higher polar moment of inertia can be more difficult to maneuver, particularly at the net or upon return of serve, than a racquet with a lower moment of inertia. Additionally, some users find large head racquets to be more difficult to swing than racquets with normal sized heads.

Other racquets have incorporated different head shapes in an effort to increase the length of certain main or cross string segments, without increasing the size of all of the main and cross-string segments. Although such designs can provide a more targeted approach to increasing the performance of the racquet, such designs can also result in an undesirable increase in the polar moment of inertia of the racquet. Further, such designs may also result in a head size that has an undesirable appearance, or an appearance that is markedly different from the look and design of traditional sport racquet designs.

Thus, there is a continuing need for a racquet having a string bed with an enlarged sweet spot and providing an increased "dwell time," without negatively effecting the overall performance of the racquet. It would be advantageous to provide a racquet with an enlarged sweet spot and an increased "dwell time" without increasing the polar moment of inertia of the racquet head and without negatively affecting the maneuverability of the racquet. It would also be advantageous to provide a means for targeting certain main and/or cross string segments in an effort to optimize the performance of a particular racquet design, without increasing the polar moment of inertia of the racquet head and without negatively affecting the maneuverability of the racquet. There is also a need for a racquet having a string bed with an enlarged sweet spot that is not a radical departure in look and design from traditional sport racquet designs.

SUMMARY OF THE INVENTION

The present invention provides a sports racquet for impacting a game ball. The sports racquet includes a frame, at least one grommet assembly and a string bed. The frame includes a head portion coupled to a handle portion. The head portion includes a hoop having inner and outer peripheral walls, at least a first set of concave recesses and a first set of channels formed into the outer peripheral wall. The first set of concave recesses are spaced apart by and interconnected with the first set of channels. The hoop includes first, second and third groups of string openings. The first group of string openings is generally circular and extends through the inner and outer peripheral walls. The second group of string openings extends through the outer peripheral wall at the at least first set of concave recesses. The third group of string openings extends through the inner peripheral wall at locations corresponding to the second group of string openings. The grommet assembly engages the outer peripheral wall. The grommet assembly includes at least three pivotable elements interconnected by torque transmitting arms. Each pivotable element includes a string passage. The string bed is formed of a plurality of cross string segments and a plurality of main string segments, and defines a string bed plane. Each string passage has a cross string segment or a main string segment extending therethrough, whereby upon impact with the ball, one or more cross or main string segments deflect thereby causing a first group of one or more pivotable elements supporting the deflecting cross or main string segments to pivot. The pivotable elements and the torque transmitting arms positioned adjacent to the first group of pivotable elements are pivotable in response to rotation of the first group of pivotable elements.

According to a principal aspect of a preferred form of the invention, a sports racquet for impacting a game ball includes a frame, at least one grommet assembly and a string bed. The frame includes a head portion coupled to a handle portion. The head portion includes a hoop having inner and outer peripheral walls, at least a first set of concave recesses and a first set of channels formed into the outer peripheral wall. The first set of concave recesses are spaced apart by and interconnected with the first set of channels. The hoop includes first, second and third groups of string openings. The first group of string openings is generally circular and extends through the inner and outer peripheral walls. The second group of string openings extends through the outer peripheral wall at the at least first set of concave recesses. The third group of string openings extends through the inner peripheral wall at locations corresponding to the second group of string openings. The grommet assembly engages the outer peripheral wall. The grommet assembly includes at least three pivotable elements interconnected by torque transmitting arms. Each pivotable element includes a string passage. The string bed is formed of a plurality of cross string segments and a plurality of main string segments, and defines a string bed plane. Each string passage has either a cross string segment or a main string segment extending therethrough. The cross or main string segment extending through one of the pivotable elements is deflectable upon impact with the game ball. The deflection of the cross or main string causes the pivotable element supporting the one deflecting cross or main string segment to rotate about an axis parallel to the string bed and to produce a torque on the pivotable elements positioned on opposite sides of the one pivotable element through the torque transmitting arms.

According to another preferred aspect of the invention, a sports racquet for impacting a game ball includes a frame, at least one grommet assembly and a string bed. The frame includes a head portion coupled to a handle portion. The head portion includes a hoop having inner and outer peripheral walls, at least a first set of concave recesses and a first set of channels formed into the outer peripheral wall. The first set of concave recesses are spaced apart by and interconnected with the first set of channels. The at least one grommet assembly engages the outer peripheral wall. The grommet assembly includes at least three pivotable elements interconnected by torque transmitting arms. Each pivotable element includes a string passage. The string bed is formed of a plurality of cross string segments and a plurality of main string segments, and defines a string bed plane. Each string passage has one of the cross string segments and main string segments extending therethrough. Each pivotable element has a first cross-sectional area measured about a first plane that is orthogonal to the string bed and parallel to the string segment extending through the pivotable element. Each torque transmitting arm has a second cross-sectional area measured about a second plane parallel to the first plane. The first cross-sectional area is greater than the second cross-sectional area.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
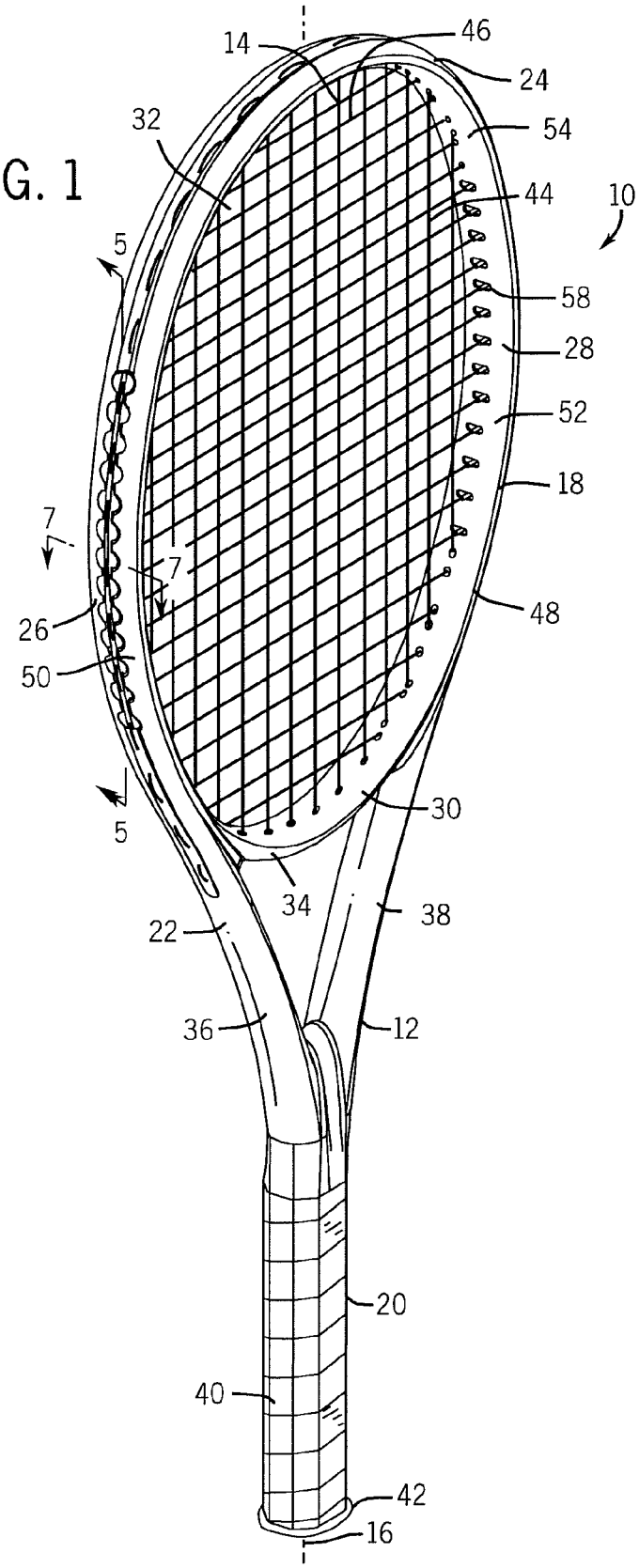
FIG. 1 is a front side perspective view of a racquet in accordance with a preferred embodiment of the present invention.
Figure 2:
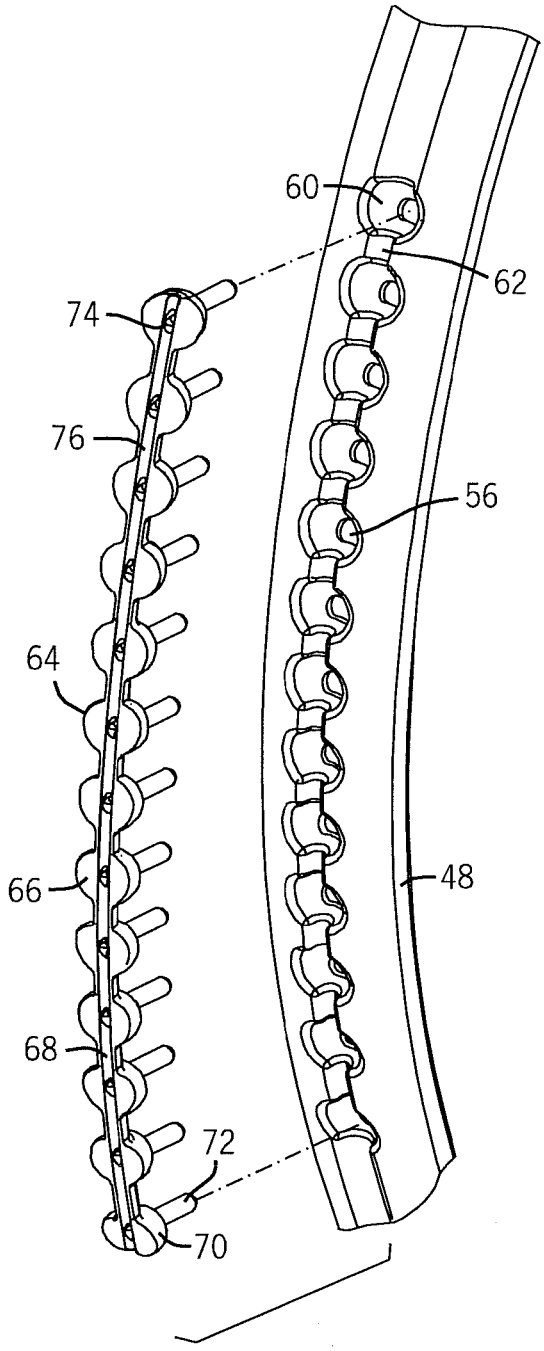
FIG. 2 is an exploded side perspective view of a portion of the hoop of a frame of the racquet illustrating a grommet assembly of FIG. 1

Referring to FIG. 1, a sports racquet is indicated generally at 10. The racquet 10 of FIG. 1 is configured as a tennis racquet, however, the invention can also be formed as other types of sports racquets, such as, for example, a racquetball racquet, a squash racquet, or a badminton racquet. The racquet 10 includes a frame 12 and a string bed 14. The frame 12 is a tubular structure having a longitudinal axis 16 and including a head portion 18, a handle portion 20, and a throat portion 22 coupling the head and handle portions 18 and 20. The frame 12 is formed of a lightweight, durable material, preferably a carbon-fiber composite material. As used herein, the term "composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In multiple layer constructions, the fibers can be aligned in different directions with respect to the longitudinal axis 24, and/or in braids or weaves from layer to layer. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers.

Alternatively, the frame 12 can be formed of other materials including metallic alloys, other composite materials, wood, or combinations thereof. The head portion 18 forms a distal region 24, first and second side regions 26 and 28, and a proximal region 30, which collectively define a string bed area 32 for receiving and supporting the string bed 14. In one preferred embodiment, the proximal region 30 includes a yoke 34.

The yoke 34 is an elongate tubular structural member which extends from the first side region 26 to the second side region 28 of the head portion 18. In one preferred embodiment, the yoke 34 is integrally formed with the frame 12 defining the proximal region 30. In alternative preferred embodiments, the yoke 34 can be connected through use of adhesives, fasteners, bonding and combinations thereof. In another embodiment, the yoke 34 can separated from the frame 12 by vibration absorbing material, such as, for example, an elastomer. The yoke 34 is formed of a light-weight, durable material, preferably a carbon-fiber composite material. Alternatively, the yoke 34 can be formed of other materials, such as, for example, metallic alloys, other composite materials including basalt fibers, and combinations thereof. The yoke 34 provides structural support to the frame 12, as well as a means for defining the lower portion of the string bed area 32 and a support for engaging, routing or directing the main string segments. In another alternative preferred embodiment, the frame 12 of the racquet 10 can be formed without a yoke.

In a preferred embodiment, the first and second side regions 26 and 28 downwardly extend from the head portion 18 to form first and second throat tubes 36 and 38 of the throat portion 22. The first and second throat tubes 36 and 38 converge further downwardly extend to form the handle portion 20. The handle portion 20 includes a pallet (not shown), a grip 40 and a butt cap 42. In alternative preferred embodiments, the handle portion 20 can be a tubular structure that does not include an extension of the first and second throat tubes. In this alternative preferred embodiment, the handle portion can be a tubular structure separate from either the throat portion or the head portion of the frame and attached to the throat portion through use of conventional fasteners, molding techniques, bonding techniques, adhesives or combinations thereof.

In another preferred embodiment, the head portion 18 is directly connected to one or both of the throat portion 22 and the yoke 34 through the use of conventional fasteners, adhesives, mechanical bonding, thermal bonding, or other combinations thereof. Alternatively, the head portion 18 can be separated from one or both of the throat portion and the yoke by a vibration and shock absorbing material, such as an elastomer. In yet another alternative preferred embodiment, the head portion 18 is integrally formed with one or both of the throat portion 22 and the yoke 16.

The string bed 14 is formed by a plurality of main string segments 44 interwoven with a plurality of cross string segments 46. The main and cross string segments 44 and 46 can be formed from one continuous piece of racquet string, or from two or more pieces of racquet string.

The head portion 18 of the racquet 10 is preferably a tubular structure shaped to define a hoop 48. The hoop 48 can be any closed curved shape including, for example, a generally oval shape, a generally tear-drop shape, a generally pear shape, a generally circular shape and combinations thereof. The hoop 48 includes an outer peripheral wall 50 and an inner peripheral wall 52. In a preferred embodiment, the hoop 48 includes first, second and third groups of string openings 54, 56 and 58 in the outer and inner peripheral walls 50 and 52, respectively.

Referring to FIGS. 2 and 4-6, at least a first set of concave recesses 60 and a first set of channels 62 are formed into the outer peripheral wall 50 of the hoop 48. The first set of concave recesses 60 are spaced apart and interconnected by the first set of channels 62. The concave recesses 60 and the channels 62 are configured to receive and operably engage an articulating grommet assembly 64. In a preferred embodiment, the concave recesses 60 are generally hemispherical recesses. In alternative preferred embodiments, the concave recesses can take other curved shapes such as semi-circular or semi-cylindrical. In one preferred embodiment, the concave recesses 60 have a depth of within the range of 2 to 8 millimeters. In a more preferred embodiment, the depth of the concave recesses is within the range of 5 to 6 millimeters. The channels 62 extend between the concave recesses 62 and preferably have a semi-cylindrical shape. Other shapes can also be used. The depth of the channels 62 are preferably within the range of 1 to 4 mm. In a particularly preferred embodiment, the depth of the channels 62 is within the range of 2 to 3 mm.

The outer surface of the outer peripheral wall 50 at the locations of the concave recesses 60 and the channels 62 are preferably substantially the same as the remaining outer surfaces of the outer peripheral wall 50. Accordingly, the surfaces of the outer peripheral wall 50 at the concave recesses 60 and the channels 62 preferably receive similar surface treatments including sanding, paint layers, clear coats, etc. as the other surfaces of the outer peripheral wall. The painted and coated outer surfaces of the outer peripheral wall 50 are generally very smooth which significantly reduces the coefficient of friction of the surface and facilitates the articulation or relative movement of the articulating grommet assembly 64 with respect to the hoop 48 of the racquet 10 upon impact of a game ball (such as a tennis ball) with the string bed 14.

In FIGS. 1, 2, 4 and 5, a portion of the hoop 48 is shown with thirteen concave recesses 60 connected by a set of twelve channels 62. In alternative preferred embodiments, the set of concave recesses 60 formed into a portion or section of the hoop 48 can be three or more, and the set of channels 62 can number two or more. In one particularly preferred embodiment, the set of concave recesses 60 number eight and the set of channels 62 number seven.

The first set of string openings 54 are generally circular shaped openings extending through the inner and outer peripheral walls and are configured for receiving racquet string segments and/or portions of a grommet. The first set of string openings 54 preferably have a diameter of approximately 3 millimeters. In other embodiments, the first set of string openings can be formed of a larger diameter. The second set of string openings 56 extend through the outer peripheral wall 50 and are preferably positioned at the location of the concave recesses 60. The third set of string openings 58 extend through the inner peripheral wall 52 and are generally aligned with the second set of string openings 56 to facilitate the passage or stringing of string segments 44 or 46. In a preferred embodiment, the second and third set of string openings 56 and 58 are formed as through-wall slots. The length (or major dimension) of the third set of string openings 58 is preferably greater than the length (or major dimension) of the second set of string openings 56. In a particularly preferred embodiment, the second set of string openings 56 have a length of 5 millimeters or greater, and the third set of string openings 58 have a length of 10 millimeters or greater. In alternative preferred embodiments, other lengths can be used for the second and third sets of string openings. In alternative preferred embodiments, the second and third set of string openings 56 and 58 can be formed in other shapes, such as, for example, circular, elliptical, rectangular, polygonal, irregular or combinations thereof.

Referring to FIGS. 1-6, the articulating grommet assembly 64 is shown. The articulating grommet assembly 64 is formed of at least three pivotable elements 66 connected by a plurality of torque transmitting arms 68. Each pivotable element 66 includes a rounded base 70 and a protective barrel 72 extending from the base 70. A string passage 74 is formed through each pivotable element 66 from the base 70 through the protective barrel 72. A string receiving groove 76 is preferably formed into an outer surface of the rounded base 70 and the torque transmitting arms 68 of the grommet assembly for routing string segments from one string passage 74 to another.

The articulating grommet assembly 64 is formed of a lightweight, durable and resilient material, preferably, a thermoplastic nylon, such as nylon 11. Alternatively, the articulating grommet assembly can be formed of other materials, such as, for example, a composite material, a urethane, a polyamide, a rubber, wood, aluminum, other metals, other thermoplastic materials and combinations thereof. In a preferred embodiment, the articulating grommet assembly 64 is formed of a generally rigid material such that rotation of one or more adjacent pivotable elements 66 about an axis 80 causes the pivotable elements 66 positioned on either side of the original one or more adjacent pivotable elements to receive a torque from the torque transmitting arms 68.

In a preferred embodiment, the rounded base 70 is generally hemispherical having a radius of within the range of 2 to 4 millimeter from the pivot axis 80 of the pivotable element 66. In a particularly preferred embodiment, the radius of the rounded base 70 is approximately 2.5 mm. In alternative preferred embodiments, the rounded base 70 can be formed in other shapes, such as for example, cylindrical, semi-cylindrical, ovoidal, other curved or bulbous shapes and combinations thereof. The protective barrel 72 provides a protective passageway for one of the string segments 44 or 46 through the second and third sets of openings 56 and 58 in the inner and outer peripheral walls 52 and 50 of the hoop 48. The protective barrel 72 preferably has a length within the range of 7 to 13 mm. In a particularly preferred embodiment, the length of the barrel 72 can be within the range of 9 to 10 mm. The protective barrel 72 is preferably tubular or cylindrical having an outer diameter and an inner diameter. In one preferred embodiment, the protective barrel has an outer diameter of approximately 2.8 mm and an inside diameter of approximately 1.6 mm (the inside diameter forming part of the string passage 74 as it extends through the barrel 72). In alternative preferred embodiments, other inner and outer diameter sizes can be used. In still other preferred embodiments, the outer shape of the barrel can take other non-cylindrical shapes. The string passage 74 extending through the base 70 and barrel 72 of the pivotable element 66 preferably has a diameter of approximately 1.6 mm. Other diameter sizes can are also contemplated. The string receiving grooves 76 formed into the outer surface of the rounded base 70 and the torque transmitting arms 68 of the grommet assembly 64 preferably have approximately 1.5 to 2.0 mm. The articulating grommet assembly 64 thereby preferably completely isolates the string segments 44 and/or 46 engaging the grommet assembly 64 from directly contacting the hoop 48. As a result, the string segments 44 and 46 engaging the grommet assembly 64 are protected from wear and abrasion with sharp or rough surfaces of the hoop 48. The string receiving grooves 76 and string passages 74 also facilitate stringing of the racquets 10.

Each pivotable element 66 has a first cross-sectional area measured about a first plane that is orthogonal to the string bed 14 and parallel to the string segment extending through the pivotable element 66. Each torque transmitting arm 68 has a second cross-sectional area measured about a second plane parallel to the first plane. The first cross-sectional area is greater than the second cross-sectional area.

The articulating grommet assemblies are preferably inserted into the corresponding locations of the hoop 48 (the corresponding locations of the set of concave recesses 60 and channels 62) and further secured by the racquet string segments 44 and 46 extending through the articulating grommet assemblies 64. In alternative preferred embodiments, the articulating grommet assemblies can be press-fit to the hoop 48. In this configuration, at least one point on the grommet assembly remains substantially fixed in relation to the hoop 48. In alternative preferred embodiments, the articulating grommet assemblies can be fixedly coupled to the hoop 48 through other means, such as, for example, other press-fit connections, conventional fasteners, adhesives, bonding and combinations thereof.

The articulating grommet assembly 64 of FIGS. 1, 2, 4 and 5 includes thirteen pivotable elements 66 connected by twelve torque transmitting arms 68. In alternative preferred embodiments, the articulating grommet assemblies 64 can include three or more pivotable elements 66 connected by two or more torque transmitting arms 68. The number of pivotable elements 66 can be varied to tailor the racquet design to best meet a user's needs.

Figure 7:
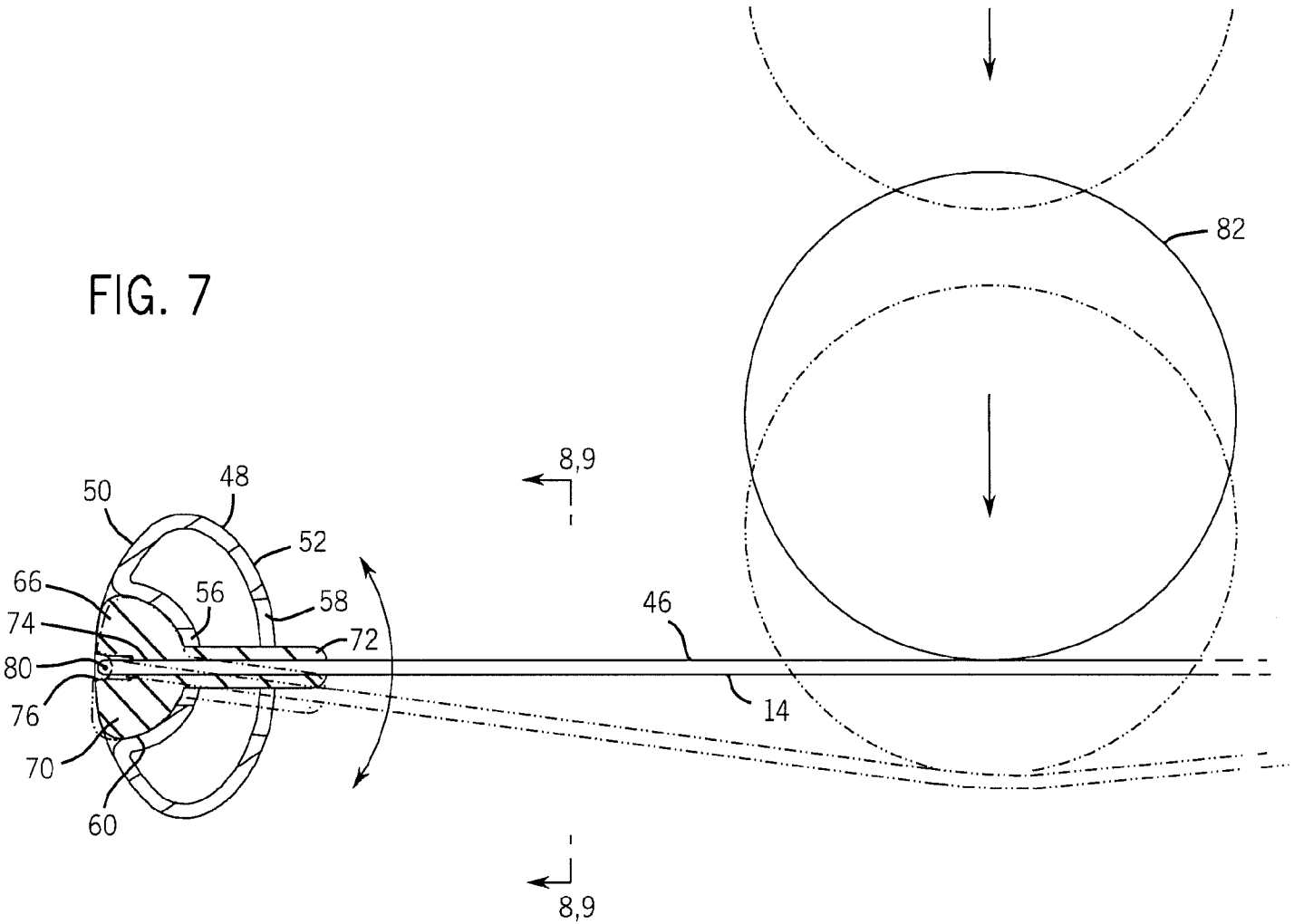
FIG. 7 is a transverse cross-sectional view of a portion of the hoop of the racquet taken along line 7-7 of FIG. 1 and showing the effect of a game ball impacting a string segment.
Figure 8:
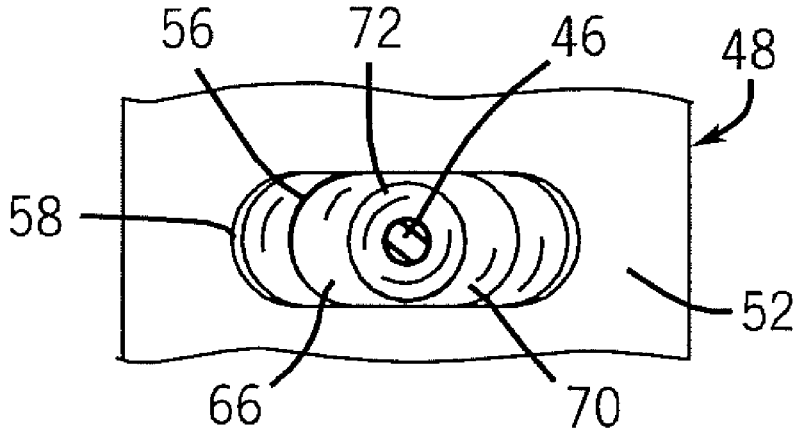
FIG. 8 is a side view of a portion the hoop of the racquet of FIG. 1 taken from the perspective of line 8-8 of FIG. 7.
Figure 9:
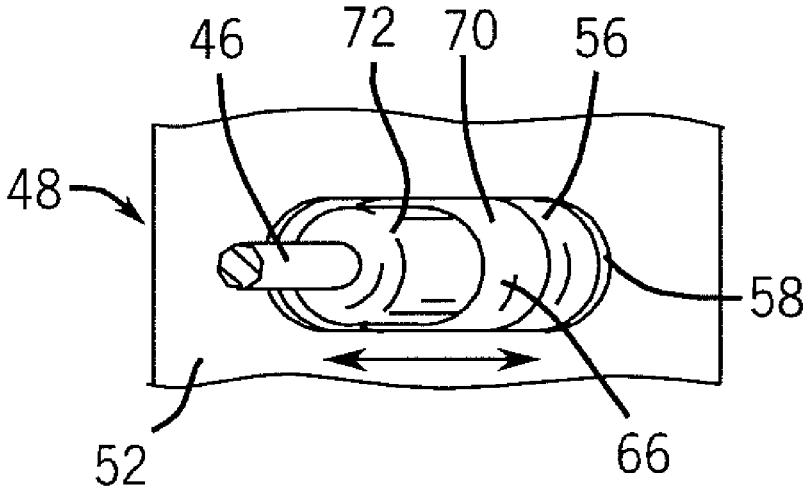
FIG. 9 is a side view of a portion the hoop of the racquet of FIG. 1 taken from the perspective of line 9-9 of FIG. 7.

Referring to FIGS. 7-9, the operation of an individual pivotable element 66 of the articulating grommet assembly 64 is shown. FIG. 7 shows a transverse cross-sectional view of the hoop 48 of the racquet 10 taken about a plane that is orthogonal to the plane defined by the string bed 14 and that is parallel to the extension of the cross string segment 48 of the string bed 14. When a game ball 82 (such as a tennis ball) impacts the string bed 14 (or a cross string segment 48) during play, the impact causes the string to deflect in response to the impact. The deflection of the string segment 48 extends to the articulating grommet assembly 64. The rounded base 70 of the pivotable element 66 rotates or articulates about the pivot axis 80 relative to the outer peripheral surface 50 forming the concave recess 60 of the hoop 14. Referring to FIGS. 7-9, the second and third string openings 56 and 58 are slotted to provide space for the string segment 48 and the protective barrel 72 to rotate, pivot or articulate about the axis 80 and move within and relative to the hoop 14 without binding or being otherwise inhibited by the inner and outer peripheral walls 52 and 50 of the hoop 14.

This rotation, pivoting or articulation enables to the string segment 48 to deflect further than it otherwise would without the rotation. This articulation or rotational movement provides an effect that is similar to that of a racquet having a longer effective string length. The rotation or articulation of the pivotable element 66 of the grommet assembly 64 relative to the hoop 48 enables the string bed 14 to deflect further upon impact with the ball and thereby provide more responsiveness and greater power transfer to the ball. Further, the increased deflection of the string bed 14 increases the "dwell time," or the duration of contact between the ball and the string bed 14 of the racquet 10 upon contact, enabling the user to impart spin more easily to the ball and to achieve better overall control of the ball during play.

Figure 5:
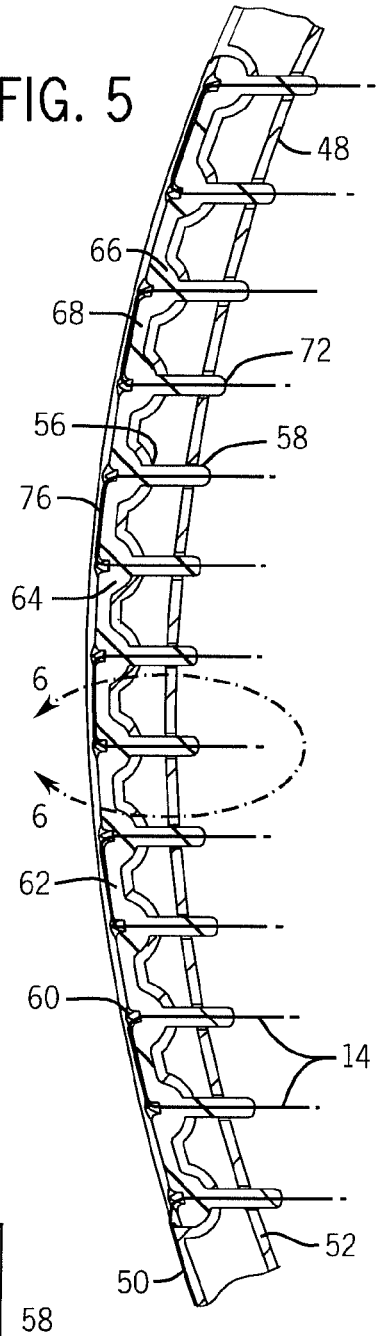
FIG. 5 is a longitudinal cross-sectional view of a portion of the hoop of the racquet taken along line 5-5 of FIG. 1.
Figure 6:
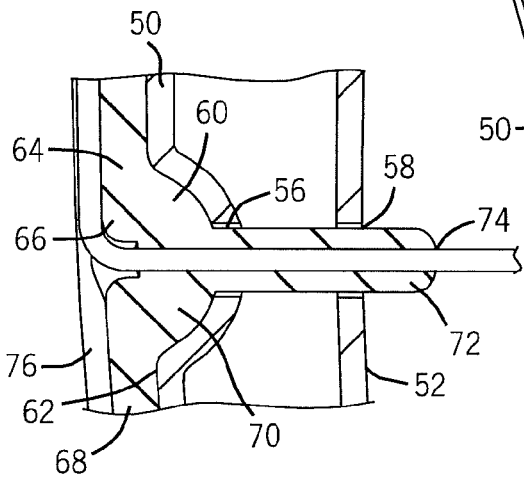
FIG. 6 is an enlarged longitudinal cross-sectional view of a portion of the hoop of the racquet from curve 6-6 of FIG. 5.

The unique construction of the articulating grommet assembly 64 with the three or more pivotable elements 66 connected by a plurality of torque transmitting arms 68 provides the additional benefit of enabling the torque or rotation of one or more pivotable elements 66 to be transmitted to other adjacent string segments 44 or 46. Referring to FIGS. 5 and 7, when the ball 82 impacts the string bed 14, the diameter of the ball causes the ball to impact two or more cross string segments 46 and/or two or more main string segments 44 (generally two to five string segments). The present invention enables the force of impact on the string bed 14 to allow for the affected pivotable elements 66 to rotate in response to the impact with the game ball 82 but also the pivotable elements of string segments 46 or 44 adjacent to the impact site also receive the torque or rotational moments due to the torque transmitting arms 68 connecting the pivotable 66. Rotation of two or more pivotable elements 66 due to an impact with the game ball creates a torque on the adjacent pivotable elements due to the torque transmitting arms 68 direct connection to the adjacent pivotable elements. This transmission of torque can allow for the adjacent pivotable elements 66 to also move, rotate, articulate or pivot with respect to the hoop 48 in response to the impact. In other words, the pivotable elements 66 are pivotable about the pivot axis 80, which is parallel to the string bed plane. Deflection of one of the cross or main string segments 46 or 44 extending through one of the pivotable elements due to impact with the game ball causes the one pivotable element 66 to rotate about the axis 80 and to produce a torque on the pivotable elements 66 positioned on opposite sides of (or directly adjacent to) the one pivotable element 66 through the torque transmitting arms 68. The torque being the moment of a force or a system of forces urging, or causing, rotation of such adjacent pivotable elements.

The result of such movement can allow for further deflection of the string bed 14 at and around the impact site, increased dwell time between the ball 82 and the string bed 14, and an enlarged sweet spot. The torque transmitting arms 68 enable the string bed 14 and the racquet as a whole to be more responsive, perform better and possess an enlarged sweet spot.

Figure 3:
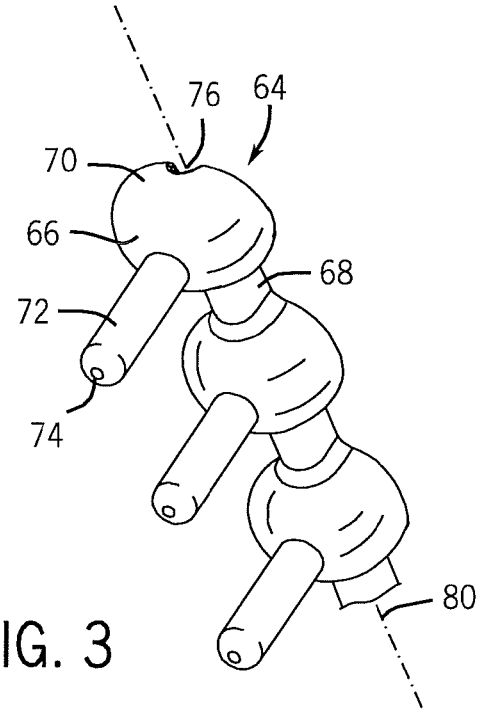
FIG. 3 is a side perspective view of a portion of a grommet assembly of the racquet of FIG. 1.
Figure 4:
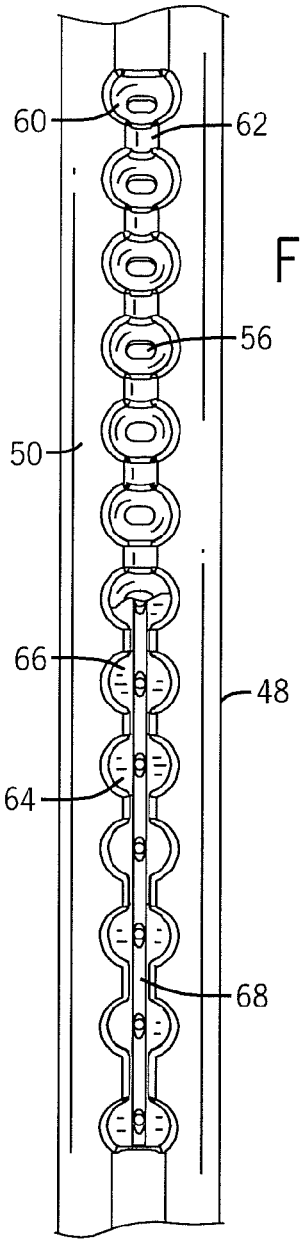
FIG. 4 is a side view of a portion of the hoop of the racquet of FIG. 1 with a portion of a grommet assembly removed.

Referring to FIG. 7, each pivotable element 66 has a first cross-sectional area when taken about a first plane orthogonal to the string bed and parallel to the string segment 46 extending therethrough. Referring to FIG. 3, each torque transmitting arm 68 has a second cross-sectional area when taken about a second plane that is parallel to the first plane. The first cross-sectional area is greater than the second cross-sectional area.

Figure 13:
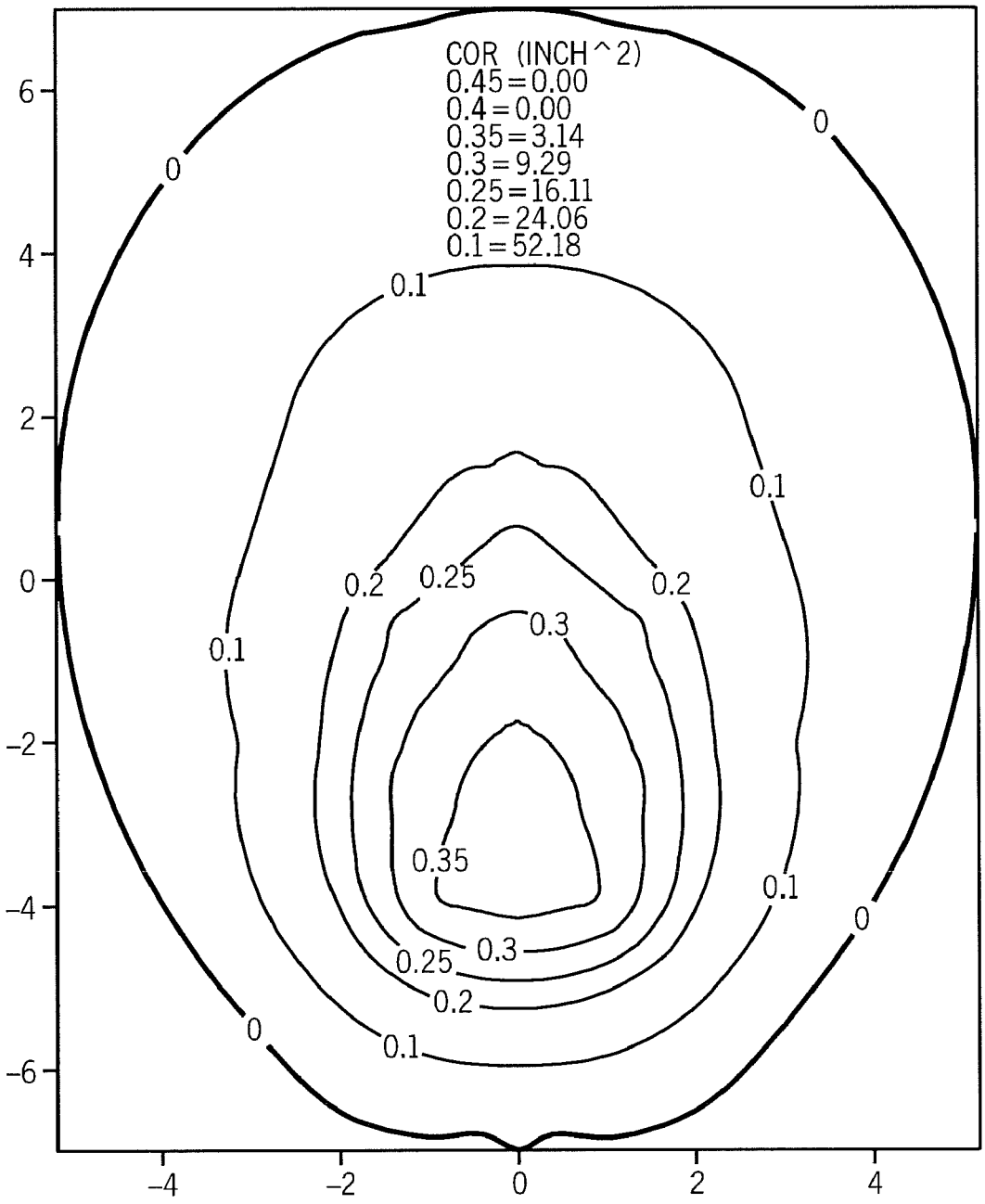
FIG. 13 is a representation of the results of coefficient of restitution measurements taken on a control racquet having a head size of 110 square inches and assembled without articulating grommet assemblies.
Figure 14:
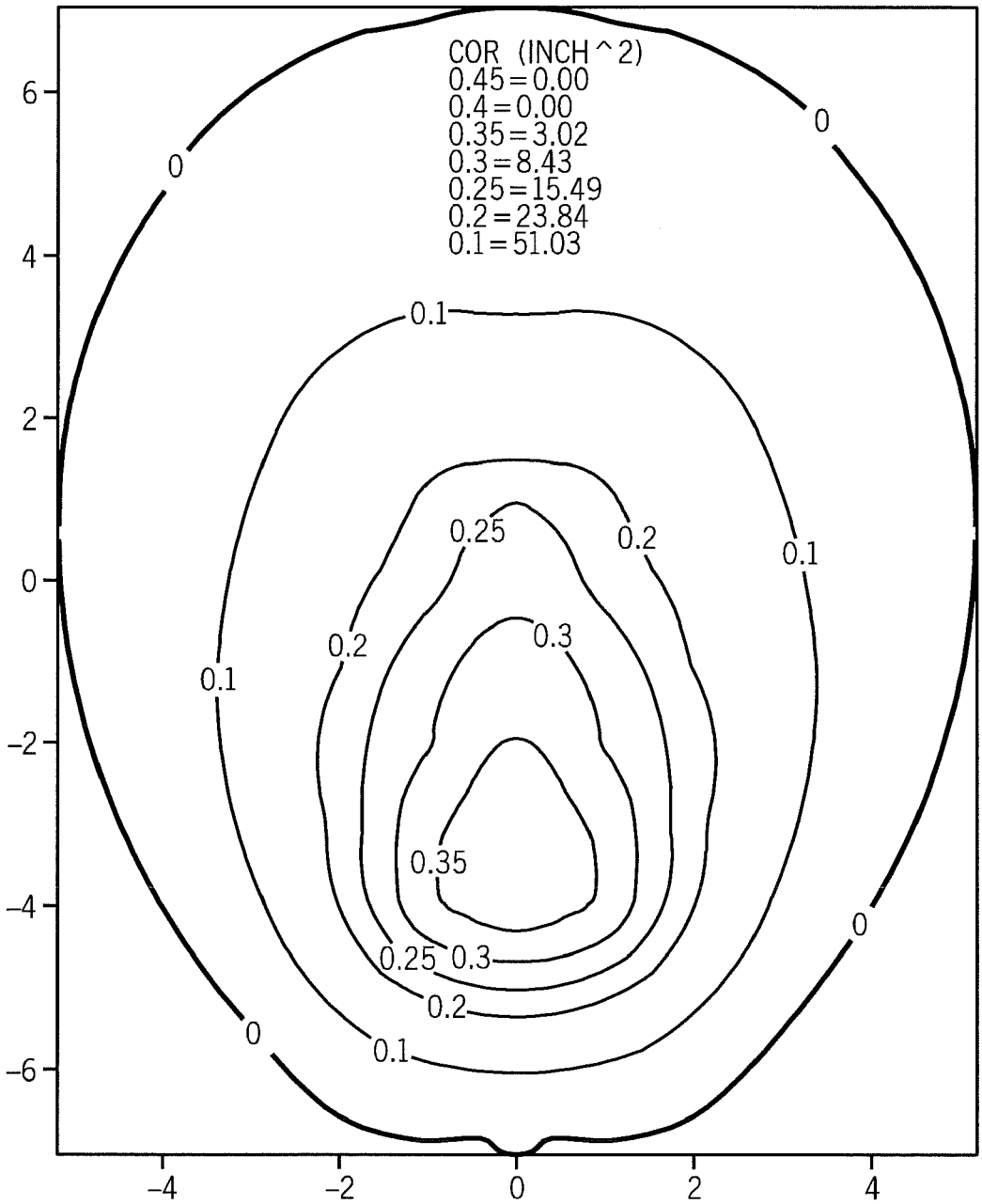
FIG. 14 is a representation of the results of coefficient of restitution measurements taken on a Prince® racquet Model No. Blue EX03 and having a head size of 110 square inches.
Figure 15:
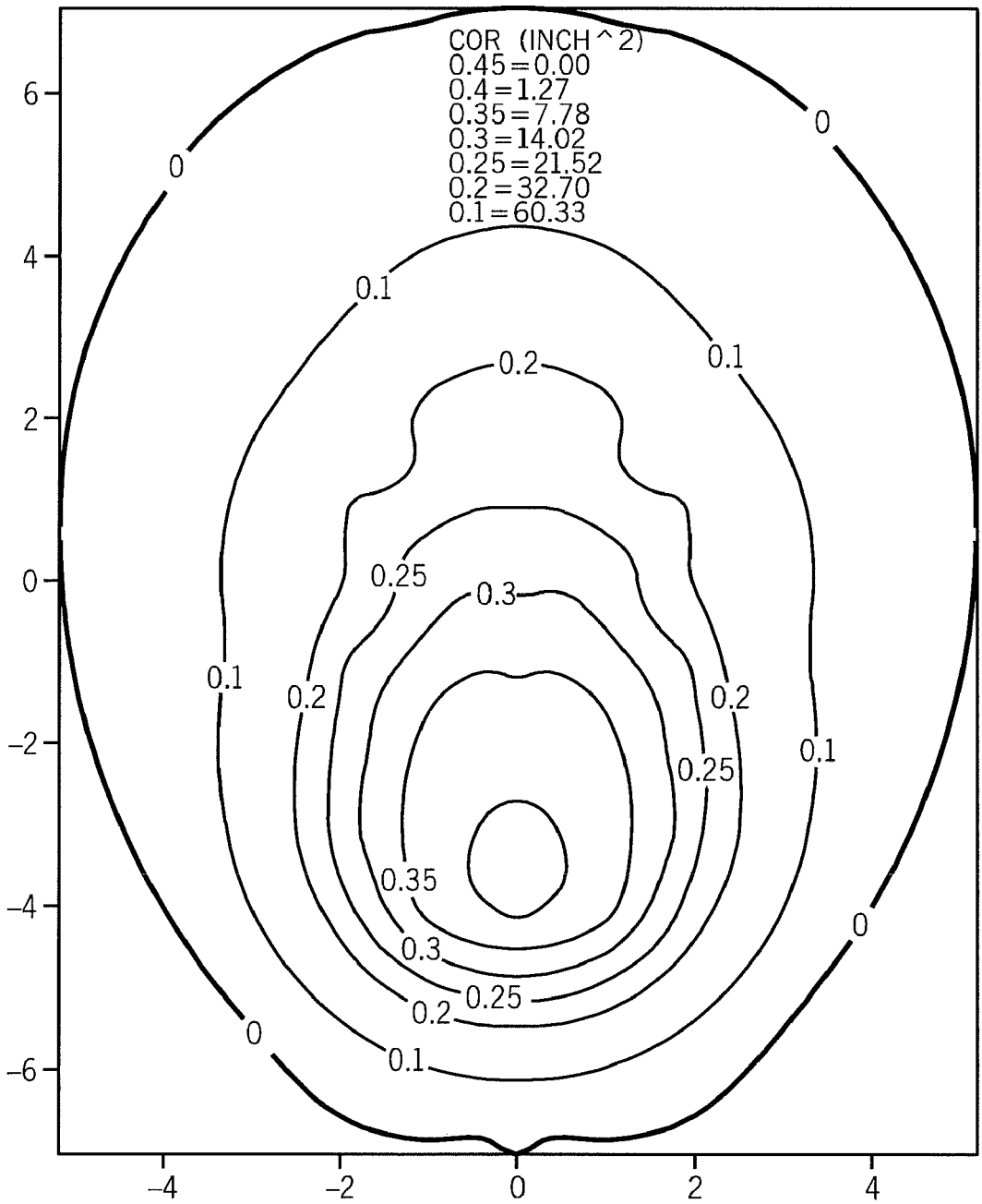
FIG. 15 is a representation of the results of coefficient of restitution measurements taken on a racquet having a head size of 110 square inches and assembled with articulating grommet assemblies in accordance with a preferred embodiment of the present invention.

Referring to FIGS. 13-15, the enlarged sweet spot obtained through incorporation of the present invention into a racquet is demonstrated. FIGS. 13-15 show the results of coefficient of restitution ("COR") tests performed on three separate racquets. Each of the three racquets have similar head and hoops shapes and sizes. All three racquets have a hoop or head size of approximately 110 square inches. The head or hoop shapes of the three racquets are conventional, traditional generally ovoidal head shapes.

FIGS. 13-15 illustrate mappings of the areas of various COR values for a racquet of the present invention and for two representative prior art racquets. The COR is the ratio of the rebound velocity of a ball, such as, for example, a tennis ball, to the incoming velocity of the ball. The COR values of FIGS. 13-15 were measured by using an incoming velocity of 90 feet per second, +/−5 feet per second. Each mapping reflects the COR values resulting from the impacts of the ball with the string bed at numerous, distributed locations about the string bed. The racquet is supported in the test apparatus only at the handle. In particular, the test apparatus secures the proximal end of the handle (approximately the proximal 6 inches of the handle). The attachment of the test apparatus to the racquet restricts the proximal end of the handle from moving or twisting along the x, y or z axes. Each racquet of FIGS. 13-15 possessed a string tension of 55 lbs tension, measured in a strung condition generally at the center of the string bed.

FIG. 13 illustrates the areas of COR for a racquet having substantially the same frame as the racquet of FIG. 15, but without the articulating grommet assemblies 64 of the present invention. The racquet of FIG. 13 is a racquet model produced by Wilson Sporting Goods Co. of Chicago, Ill., and serves as a control racquet. The numerical values of the COR areas for the racquet mapped in FIG. 13 are provided in Table 1. The maximum COR reading for the racquet of FIG. 13 was 0.35 with an area of 0.35 COR of 3.14 square inches.

FIG. 14 illustrates the areas of COR for a representative prior art racquet. The racquet is a Prince® racquet, Model Blue EX03' produced by Prince Tennis of Bordentown, N.J. The racquet has generally the same shape, approximately the same head size, and a similar swing weight as the racquets of FIGS. 13 and 15, and was selected as a representative prior art racquet. The numerical values of the COR areas for the racquet mapped in FIG. 14 are provided in Table 1. The maximum COR reading for the racquet of FIG. 14 was 0.35 with an area of 0.35 COR of 3.02 square inches.

FIG. 15 illustrates the enlarged areas of COR for a racquet built in accordance with a preferred embodiment of the present invention. The racquet of FIG. 15 includes two articulating grommet assemblies 64 and corresponding sets of concave recesses 60 and channels 62 generally positioned at the 3 and 9 o'clock locations about the hoop 48. Each articulating grommet assembly of the racquet of FIG. 15 includes eight pivotable elements 66 (and eight corresponding concave recesses 60) and seven torque transmitting arms 68 connecting the eight pivotable elements 66. Accordingly, the articulating grommet assemblies of the racquet of FIG. 15 actively engage and effect eight separate cross string segments 48 of the racquet. The numerical values of the COR areas for the racquet mapped in FIG. 15 are also provided in Table 1. The maximum COR reading for the racquet of FIG. 15 was 0.40 with an area of 0.40 COR of 1.27 square inches, and an area of 0.35 COR or greater of 7.78 square inches.

In FIGS. 13-15, the line labeled 0.45 represents the border of the area on the strings where the COR was 0.45 or greater. The line indicated as 0.40 represents the border of the area on the strings where the COR was 0.40 or greater. Similarly, the other lines in FIGS. 13-15 represent borders for the areas on the strings for various values of COR. The "sweet spot" of the racquet is generally defined as the area of the string bed having one of the three following COR values: 2.5 or greater, 3.0 or greater, or 3.5 or greater. The numbers on the horizontal and vertical axes of FIGS. 13-15 represent the distance from the center of the strung surface. For example, the center of the strung surface is indicated as 0.00. Two inches to the right of center of the strung surface is indicated as 2.00, 2 inches to the left of the center is indicated as −2.00, etc.

Table 1 below summarizes the COR data provided on FIGS. 13-15.

TABLE 2

COMPARISON OF COR AREAS FOR RACQUETS OF PRESENT INVENTION WITH TWO PRIOR ART RACQUETS

| COR | WILSON RACQUET OF FIG. 13 SQ. INCHES | PRINCE RACQUET OF FIG. 14 SQ. INCHES | RACQUET OF PRESENT INVENTION (FIG. 15) SQ. INCHES | % DIFFERENCE |
|---|---|---|---|---|
| 0.45 | 0.00 | 0.00 | 0.00 | 0% |
| 0.40 | 0.00 | 0.00 | 1.27 | |
| 0.35 | 3.14 | 3.02 | 7.78 | 147% & 157% |
| 0.30 | 9.29 | 8.43 | 14.02 | 51% & 66% |
| 0.25 | 16.11 | 15.49 | 21.52 | 34% & 39% |
| 0.20 | 24.06 | 23.84 | 32.70 | 36% & 37% |
| 0.10 | 52.18 | 51.03 | 60.33 | 11% & 18% |

A comparison of FIGS. 13-15 and the data of Table 1 indicates that the racquet made in accordance with the invention has a significantly greater "sweet spot" than either of the prior art racquets of FIGS. 13 and 14. The racquet of FIG. 15 of the present invention has greater area within most of the border lines for various CORs, and achieves a higher level of COR (0.40). In the 0.35 COR area, the improvement in the sweet spot area is dramatic with increases over 140%

The incorporation of the present invention significantly improves the racquet's performance by increasing the effective length of the applicable string segments. The articulating grommet assemblies provide an effect that is similar to the effect achieved with longer racquet string segments or a larger hoop or string bed. The present invention provides this significant advantage without requiring an increase in the size of the head portion and the corresponding undesirable increase in the polar moment of inertia of the racquet.

Figure 10:
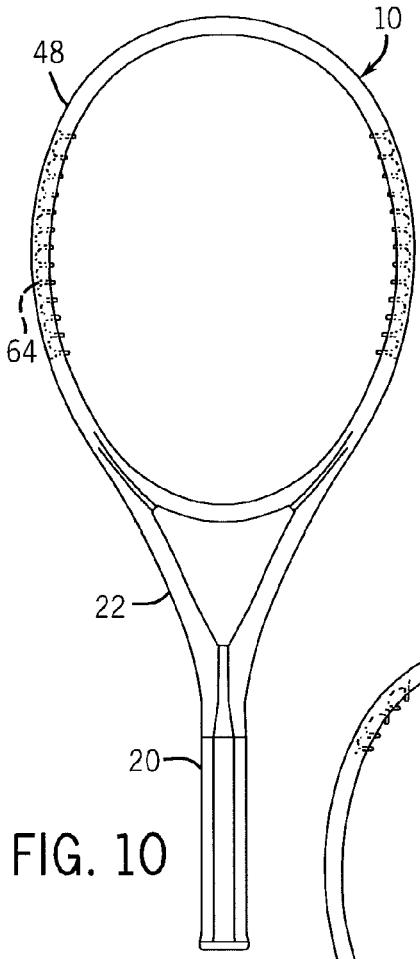
FIG. 10 is a front view of the frame of the racquet of FIG. 1 having two grommet assemblies positioned at approximately the 3 and 9 o'clock positions about the hoop of the racquet.
Figure 11:
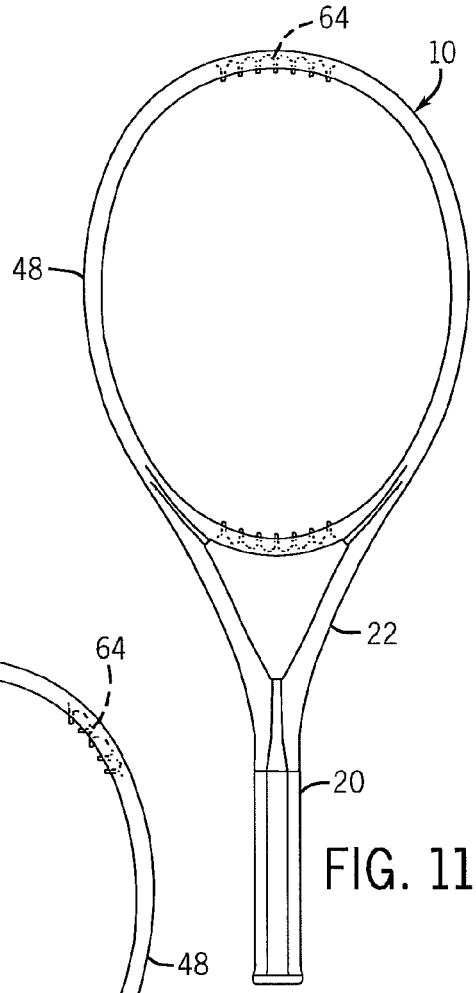
FIG. 11 is a front view of the frame of a racquet having two grommet assemblies positioned at approximately the 6 and 12 o'clock positions about the hoop of the racquet in accordance with an alternative preferred embodiment of the present invention.
Figure 12:
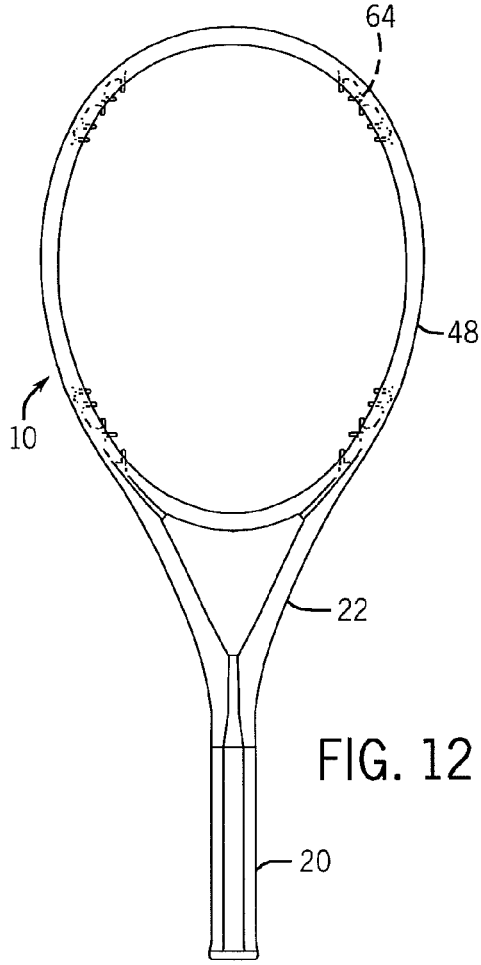
FIG. 12 is a front view of the frame of a racquet having four grommet assemblies positioned at approximately the 2, 4, 8 and 10 o'clock positions about the hoop of the racquet in accordance with an alternative preferred embodiment of the present invention.

Referring to FIGS. 10-12, in preferred embodiments of the present invention, the articulating racquet assemblies 64 can be positioned in one or more various positions about the hoop 48 thereby improving the performance of various regions of the string bed of the racquet 10. In FIG. 10, two articulating grommet assemblies are shown positioned at the 3 and 9 o'clock positions. In FIG. 11, the articulating grommet assemblies 64 are positioned at the 12 and 6 o'clock positions about the hoop 48 of the racquet thereby primarily effecting the main string segments 44 of the string bed 14. In FIG. 12, the articulating grommet assemblies are shown positioned at the 2, 4, 8 and 10 o'clock positions about the hoop 48 of the racquet 10. This configuration serves to improve the performance of the string bed that generally provides the lowest level of performance. In other preferred embodiments, one or more articulating grommet assemblies can be positioned in other locations and other numbers about the hoop. The present invention allows for a wide range of potential arrangements and configurations of the articulating grommet assemblies on or about the hoop of a racquet, thereby maximizing the flexibility of the racquet design and allowing the racquet to be customized or tailored to meet the needs of a particular player or type of player.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A sports racquet for impacting a game ball, the racquet comprising:

a frame including a head portion coupled to a handle portion, the head portion including a hoop having inner and outer peripheral walls, at least a first set of concave recesses and a first set of channels formed into the outer peripheral wall, the first set of concave recesses being spaced apart by and interconnected with the first set of channels, the hoop including first, second and third groups of string openings, the first group of string openings being generally circular and extending through the inner and outer peripheral walls, the second group of string openings extending through the outer peripheral wall at the at least first set of concave recesses, the third group of string openings extending through the inner peripheral wall at locations corresponding to the second group of string openings;

at least one grommet assembly engaging the outer peripheral wall, the grommet assembly including at least three pivotable elements interconnected by torque transmitting arms, each pivotable element including a string passage; and a string bed formed of a plurality of cross string segments and a plurality of main string segments, and defining a string bed plane, each string passage having one of the cross string segments and main string segments extending therethrough, whereby upon impact with the ball, one or more cross or main string segments deflect thereby causing a first group of one or more pivotable elements supporting the deflecting cross or main string segments to pivot, and the pivotable elements and the torque transmitting arms positioned adjacent to the first group of pivotable elements being pivotable in response to rotation of the first group of pivotable elements.

2. The sports racquet of claim 1, wherein the first group of string openings have a diameter of a first predetermined dimension, the second group of string openings have a second major dimension in a direction orthogonal to the string bed plane that is greater than the first predetermined dimension.

3. The sports racquet of claim 2, wherein the third group of string openings have a third major dimension in a direction orthogonal to the string bed plane that is greater than the second major dimension of the second group of string openings.

4. The sports racquet of claim 1, wherein the second and third groups of string openings are slots extending in a direction orthogonal to the string bed plane.

5. The sports racquet of claim 4, wherein the length of the slot of the third group of string openings is greater than the length of the second group of string openings, wherein the length of the slot of the third group of string openings is equal to or greater than 10 mm, and wherein the length of the slot of the second group of string openings is equal to or greater than 5 mm.

6. The sports racquet of claim 1, wherein the concave recesses are generally hemispherical.

7. The sports racquet of claim 1, wherein the pivotal elements include a rounded base and a protective barrel extending from the base, wherein the rounded base is configured to operably engage the concave recesses of the outer peripheral wall.

8. The sport racquet of claim 7, wherein a string receiving groove is formed into and along peripheral outer surfaces of the torque transmitting arms and the base of the pivotal elements.

9. The sports racquet of claim 7, wherein the rounded base of the pivotal element is generally hemispherical.

10. The sports racquet of claim 7, wherein the second and third groups of string openings are sized to receive the protective barrel of the pivotal elements, and wherein the second and third groups of string openings are also sized to enable movement of the protective barrel about the axis and in a second plane that is generally orthogonal to the string bed plane.

11. The sports racquet of claim 7, wherein the at least grommet assembly includes at least six of the pivotal elements interconnected by at least five of the torque transmitting arms, and wherein the corresponding first set of concave recesses numbers at least six and the first set of channels numbers at least five.

12. The sports racquet of claim 7, wherein the at least grommet assembly includes at least eight of the pivotal elements interconnected by at least seven of the torque transmitting arms and wherein the corresponding first set of concave recesses numbers at least eight and the first set of channels numbers at least seven.

13. The sports racquet of claim 1, wherein the position of the handle portion relative to the hoop of the frame defines approximately the six o'clock position about the hoop, wherein the at least the first set of concave recesses and the first set of channels are positioned at approximately the three and nine o'clock positions about the hoop of the racquet, and wherein the at least one grommet assembly is two grommet assemblies positioned at approximately the three and nine o'clock positions about the hoop of the racquet.

14. The sports racquet of claim 1, wherein the position of the handle portion relative to the hoop of the frame defines approximately the six o'clock position about the hoop, wherein the at least the first set of concave recesses and the first set of channels are two sets of concave recesses and two sets of channels positioned at approximately the six and twelve o'clock positions about the hoop of the racquet, and wherein the at least one grommet assembly is two grommet assemblies positioned at approximately the six and twelve o'clock positions about the hoop of the racquet.

15. The sports racquet of claim 1, wherein the position of the handle portion relative to the hoop of the frame defines approximately the six o'clock position about the hoop, wherein the at least the first set of concave recesses and the first set of channels are two sets of concave recesses and two sets of channels positioned at approximately the six and twelve o'clock positions about the hoop of the racquet, and wherein the at least one grommet assembly is two grommet assemblies positioned at approximately the six and twelve o'clock positions about the hoop of the racquet.

16. The sports racquet of claim 1, wherein the position of the handle portion relative to the hoop of the frame defines approximately the six o'clock position about the hoop, wherein the at least the first set of concave recesses and the first set of channels are four sets of concave recesses and four sets of channels positioned at approximately the three, six, nine and twelve o'clock positions about the hoop of the racquet, and wherein the at least one grommet assembly is two grommet assemblies positioned at approximately the three, six, nine and twelve o'clock positions about the hoop of the racquet.

17. The sports racquet of claim 1, wherein the position of the handle portion relative to the hoop of the frame defines approximately the six o'clock position about the hoop, wherein the at least the first set of concave recesses and the first set of channels are at least two sets of concave recesses and at least two sets of channels positioned at two of approximately the two, four, eight and ten o'clock positions about the hoop of the racquet, and wherein the at least one grommet assembly is at least two grommet assemblies positioned at two of approximately the two, four, eight and ten o'clock positions about the hoop of the racquet.

18. The sports racquet of claim 1, wherein upon the impact of the game ball with the string bed, the first group of one or more pivotable elements rotate and transmit a torque through the torque transmitting arms to the pivotal elements positioned adjacent to the first group of pivotal elements.

19. The sports racquet of claim 1, wherein upon impact of the game ball with one of the main string segments and cross string segments extending through the string passage of one of the pivotal elements causes rotation of the pivotal element relative to the corresponding concave recess of the outer peripheral wall.

20. A sports racquet for impacting a game ball, the racquet comprising:

a frame including a head portion coupled to a handle portion, the head portion including a hoop having inner and outer peripheral walls, at least a first set of concave recesses and a first set of channels formed into the outer peripheral wall, the first set of concave recesses being spaced apart by and interconnected with the first set of channels, the hoop including first, second and third groups of string openings, the first group of string openings being generally circular and extending through the inner and outer peripheral walls, the second group of string openings extending through the outer peripheral wall at the at least first set of concave recesses, the third group of string openings extending through the inner peripheral wall at locations corresponding to the second group of string openings;

at least one grommet assembly engaging the outer peripheral wall, the grommet assembly including at least three pivotable elements interconnected by torque transmitting arms, each pivotable element including a string passage; and a string bed formed of a plurality of cross string segments and a plurality of main string segments, and defining a string bed plane, each string passage having one of the cross string segments and main string segments extending therethrough, the cross or main string segment extending through one of the pivotable elements being deflectable upon impact with the game ball, the deflection of the cross or main string causing the pivotable element supporting the one deflecting cross or main string segment to rotate about an axis parallel to the string bed and to produce a torque on the pivotable elements positioned on opposite sides of the one pivotable element through the torque transmitting arms.

21. A sports racquet for impacting a game ball, the racquet comprising:

a frame including a head portion coupled to a handle portion, the head portion including a hoop having inner and outer peripheral walls, at least a first set of concave recesses and a first set of channels formed into the outer peripheral wall, the first set of concave recesses being spaced apart by and interconnected with the first set of channels;

at least one grommet assembly engaging the outer peripheral wall, the grommet assembly including at least three pivotable elements interconnected by torque transmitting arms, each pivotable element including a string passage; and a string bed formed of a plurality of cross string segments and a plurality of main string segments, and defining a string bed plane, each string passage having one of the cross string segments and main string segments extending therethrough, each pivotable element having a first cross-sectional area measured about a first plane that is orthogonal to the string bed and parallel to the string segment extending through the pivotable element, each torque transmitting arm having a second cross-sectional area measured about a second plane parallel to the first plane, the first cross-sectional area being greater than the second cross-sectional area.

* * * * *